US009728830B2

(12) United States Patent
Zhao et al.

(10) Patent No.: US 9,728,830 B2
(45) Date of Patent: Aug. 8, 2017

(54) DIELECTRIC RESONATOR AND FILTER INCLUDING A DIELECTRIC COLUMN SECURED TO A HOUSING USING MULTIPLE INSULATING FIXED MODULES

(71) Applicant: ZTE CORPORATION, Shenzhen, Guangdong Province (CN)

(72) Inventors: Lijuan Zhao, Shenzhen (CN); Nan Shen, Shenzhen (CN); Wende Bai, Shenzhen (CN); Hong Zhou, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 0 days.

(21) Appl. No.: 14/764,182

(22) PCT Filed: Oct. 10, 2013

(86) PCT No.: PCT/CN2013/084943

§ 371 (c)(1),
(2) Date: Jul. 29, 2015

(87) PCT Pub. No.: WO2014/127639

PCT Pub. Date: Aug. 28, 2014

(65) Prior Publication Data

US 2015/0364808 A1 Dec. 17, 2015

(30) Foreign Application Priority Data

Feb. 25, 2013 (CN) ..... 2013 1 0058986

(51) Int. Cl.
*H01P 1/20* (2006.01)
*H01P 7/10* (2006.01)
(Continued)

(52) U.S. Cl.
CPC ..... *H01P 1/2084* (2013.01); *H01P 1/20* (2013.01); *H01P 1/2002* (2013.01); *H01P 7/10* (2013.01);
(Continued)

(58) Field of Classification Search
CPC ..... H01P 1/2084; H01P 1/2086; H01P 7/10
(Continued)

(56) References Cited

U.S. PATENT DOCUMENTS 4,639,699 A * 1/1987 Nishikawa et al. ..... H01P 7/10 333/202
4,855,693 A 8/1989 Matsukura et al.
(Continued)

FOREIGN PATENT DOCUMENTS

CN 1330430 A 1/2002
CN 101826649 A 9/2010
(Continued)

*Primary Examiner* — Benny Lee
(74) *Attorney, Agent, or Firm* — Ling Wu; Stephen Yang; Ling and Yang Intellectual Property

(57) ABSTRACT

A dielectric resonator, an assembly method thereof and a dielectric filter enable are provided. The dielectric resonator includes the dielectric resonant column, the metal cavity, a sealing cover plate and a tuning screw, wherein the dielectric resonant column is located in the metal cavity, the sealing cover plate is located on an upper end face of the metal cavity, and the tuning screw is located on the sealing cover plate. The dielectric resonator also includes an insulating fixed module located between the lower end face of the sealing cover plate and the upper end face of the dielectric resonant column, and the insulating fixed module is high enough to ensure that a pressure is formed between the sealing cover plate and the dielectric resonant column, so that the dielectric resonant column is fixed at the bottom of the metal cavity.

14 Claims, 2 Drawing Sheets

(51) Int. Cl.
*H01P 1/208* (2006.01)
*H01P 11/00* (2006.01)

(52) U.S. Cl.
CPC ..... *H01P 11/008* (2013.01); *Y10T 29/49018* (2015.01)

(58) Field of Classification Search
USPC ..... 333/202, 235
See application file for complete search history.

(56) References Cited

U.S. PATENT DOCUMENTS

| | | | | |
|---|---|---|---|---|
| 5,221,913 | A * | 6/1993 | Ishizaki et al. ..... | H01P 7/10 333/219.1 |
| 5,652,556 | A | 7/1997 | Flory et al. | |
| 2004/0174234 | A1* | 9/2004 | Enokihara et al. ..... | H01P 7/10 333/202 |

FOREIGN PATENT DOCUMENTS

| | | | |
|---|---|---|---|
| CN | 102025008 | A | 4/2011 |
| CN | 102368574 | A | 3/2012 |
| CN | 102637940 | A | 8/2012 |
| CN | 102903987 | A | 1/2013 |
| CN | 103050760 | A | 4/2013 |

* cited by examiner

DIELECTRIC RESONATOR AND FILTER INCLUDING A DIELECTRIC COLUMN SECURED TO A HOUSING USING MULTIPLE INSULATING FIXED MODULES

TECHNICAL FIELD

The embodiments of the present invention relate to the filter technology, and in particular, to a dielectric resonator, an assembly method thereof and a dielectric filter.

BACKGROUND

When an electromagnetic wave is propagated in a substance with a high dielectric constant, the wavelength thereof will get shorter. With such characteristics, the conventional metal material may be substituted with a dielectric material to reduce the volume of the filter under the same requirements. The research on the dielectric filter is always a hot point in the communication industry. The filter acts as an important component in the wireless communication product. The dielectric filter, especially the dielectric resonator constituting the dielectric filter, is of particularly important meaning for miniaturization of the communication product.

In general, a single-ended conductive dielectric resonator, as shown in FIG. 1, is primarily comprised of a dielectric resonant column 103, a sealing cover plate 102, a tuning screw 101, and a metal cavity 104.

According to the working principle of a Transverse Magnetic (TM) mode dielectric resonant cavity, when the single-ended conductive dielectric resonator operates normally, an upper end face of the dielectric resonant column 103 does not contact with a lower end face of the sealing cover plate 102, and there is a high electric field distribution in a portion where the lower end face of the dielectric resonant column 103 contacts with the metal cavity 104. If the lower end face of the dielectric resonant column 103 contacts with the metal cavity 104 insufficiently, it will result in that a resistance is discontinuous, the energy of the field cannot be transmitted, and a high dielectric constant and high quality factor of the medium cannot be achieved, or even that the medium will be burned out. Therefore, whether the lower end face of the dielectric resonant column contacts well with the end face of the metal cavity in the single-ended conductive dielectric resonator is especially crucial. How to solve the fixing and contact between the lower end face of the dielectric resonant column and the end face of the metal cavity in the single-ended conductive dielectric resonator becomes an important research direction in the application of the dielectric filter.

The existing single-ended conductive dielectric resonator is shown in FIG. 1, in which the lower end face of the dielectric resonant column 103 is welded directly on the metal cavity 104, to closely contact with the bottom face of the metal cavity 104. The sealing cover plate 102 is sealed together with the metal cavity 104 using a screw, to form a closed cavity. As the dielectric resonant column 103 is welded directly on the bottom of the metal cavity 104, there are very high requirements on the welding process, and there may be a shedding phenomenon in the whole process of welding the dielectric resonant column 103, which may seriously influence the performance and working life of the filter.

In the Chinese patent CN201020138885, there is provided a dielectric resonator including a dielectric resonant column, a cavity, and a cover plate, wherein the dielectric resonant column is arranged in the cavity, further comprising: a metal base of the dielectric resonant column, wherein a bottom face of the dielectric resonant column is welded at a first end of the metal base, the metal base is fixed on the bottom face of the cavity through a screw, and there are sharp teeth around a contact face between a second end of the metal base and the cavity, to reduce a contact area between the metal base and the bottom face of the cavity. In a specific implementation process of this patent, the assembly process is complex, and there are high requirements on the structural design and high influence on the performance, which are disadvantageous for mass production and cause high cost.

SUMMARY OF THE INVENTION

The primary purpose of the embodiments of the present invention is to provide a dielectric resonator, which can enable the dielectric resonant column to well contact with the metal cavity, thereby improving the performance of the filter.

In addition, there is further provided a method for assembling a dielectric resonator, which can enable the dielectric resonant column to contact well with the metal cavity, thereby improving the performance of the filter.

In addition, there is further provided a dielectric filter, which can enable the dielectric resonant column to contact well with the metal cavity, thereby improving the performance of the filter.

A dielectric resonator comprises a dielectric resonant column, a metal cavity, a sealing cover plate and a tuning screw, wherein the dielectric resonant column is located in the metal cavity, the sealing cover plate is located on an upper end face of the metal cavity, and the tuning screw is located on the sealing cover plate. The dielectric resonator further comprises: an insulating fixed module located between the lower end face of the sealing cover plate and the upper end face of the dielectric resonant column, a lower end face of the sealing cover plate presses above the insulating fixed module and an upper end face of the dielectric resonant column supports the insulating fixed module, a pressure is formed between the sealing cover plate and the dielectric resonant column, so that the dielectric resonant column is fixed at the bottom of the metal cavity.

Preferably, the insulating fixed module is an insulator.

Preferably, the insulating fixed module is an elastic insulator.

Preferably, the insulating fixed module is fixed on the lower end face of the sealing cover plate and is located between the lower end face of the sealing cover plate and the upper end face of the dielectric resonant column.

Preferably, there is configured one insulating fixed module.

Preferably, there are configured multiple insulating fixed modules.

Preferably, there is a silver layer plated on the lower end face of the dielectric resonant column.

A dielectric filter comprises one or more connected dielectric resonators as described above.

A method for assembling a dielectric resonator, comprising: fixing a lower end face of a dielectric resonant column to a metal cavity; installing a sealing cover plate with an insulating fixed module on the metal cavity; and assembling a tuning screw on the sealing cover plate installed on the metal cavity.

Preferably, the step of installing a sealing cover plate with an insulating fixed module on the metal cavity comprises: fixing the insulating fixed module on a lower end face of the sealing cover plate, wherein a lower end face of the sealing cover plate presses above the insulating fixed module and an upper end face of the dielectric resonant column supports the insulating fixed module, a pressure is formed between the sealing cover plate and the dielectric resonant column, so that the dielectric resonant column is fixed at the bottom of the metal cavity; and installing the sealing cover plate with the insulating fixed module on the metal cavity, wherein the insulating fixed module is located between the lower end face of the sealing cover plate and the upper end face of the dielectric resonant column.

Preferably, the insulating fixed module is an insulator.

Preferably, the insulating fixed module is an elastic insulator.

Preferably, there is configured one or more insulating fixed modules.

Compared with the related art, the dielectric resonant column is fixed at the bottom of the metal cavity through the insulating fixed module without welding in an embodiment of the present invention, then well contact between the dielectric resonant column and the metal cavity can be ensured, and even when the metal cavity is under an external force or the metal cavity is during the process of transportation, good contact can be ensured, so that the performance and reliability of the dielectric filter are improved.

DETAIL DESCRIPTION OF PREFERRED EMBODIMENTS OF THE PRESENT INVENTION

The technical schemes in the embodiments of the present invention will be described in detail below in conjunction with accompanying drawings in the embodiments of the present invention. The embodiments as described are merely a part of the embodiments of the present invention, instead of all embodiments. A person of ordinary skilled in the art can obtain other embodiments based on the embodiments of the present invention without any creative labor, and all these embodiments belong to the protection scope of the present document. It should be illustrated that without a conflict, the embodiments in the present application and the features in the embodiments can be combined with each other randomly.

Figure 1:
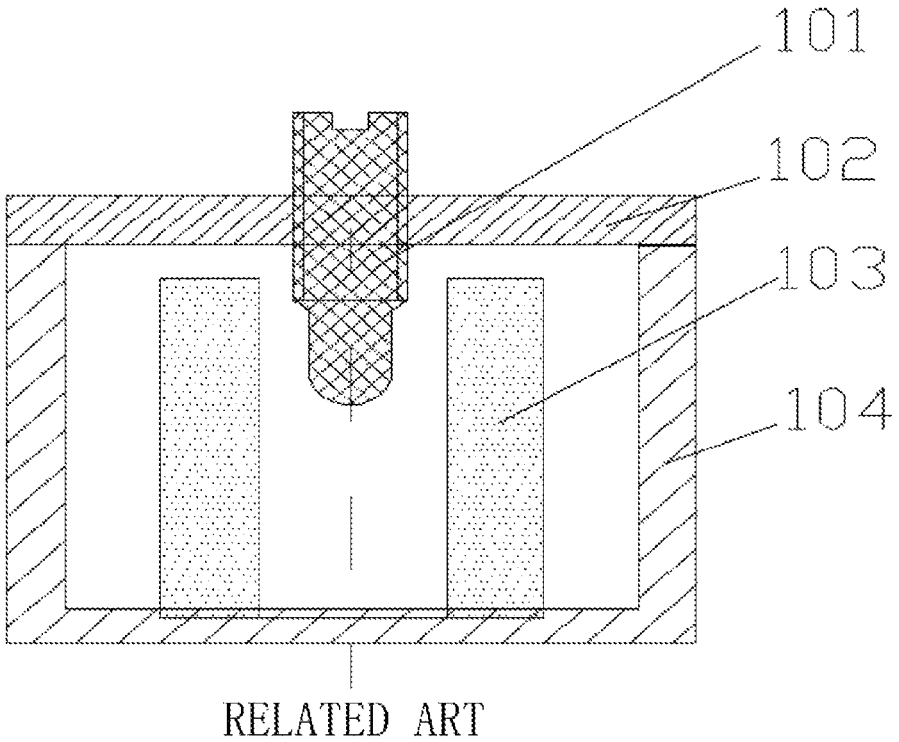
FIG. 1 is a diagram of a dielectric filter in the related art.
Figure 2:
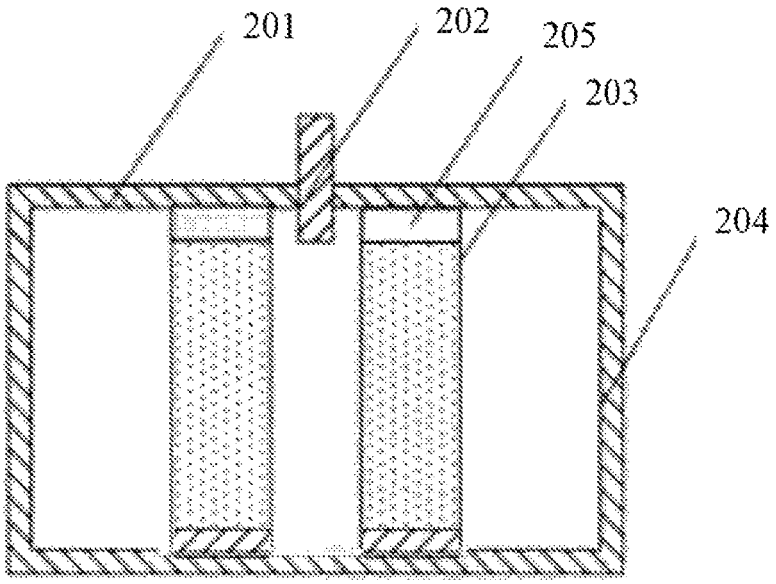
FIG. 2 is a diagram of a structure of a dielectric resonator according to a first embodiment of the present invention.

With reference to FIG. 2, illustrated is a diagram of a structure of a dielectric resonator according to a first embodiment of the present invention.

The dielectric resonator includes a dielectric resonant column 203, a sealing cover plate 201, a tuning screw 202, a metal cavity 204, and an insulating fixed module 205.

The dielectric resonant column 203 is located in the metal cavity 204, and the lower end face of the dielectric resonant column 203 is metalized (for example, a silver layer is plated on the lower end face of the dielectric resonant column), to ensure transmission of the electromagnetic wave between the dielectric resonant column 203 and the metal cavity 204.

The tuning screw 202 is located on the sealing cover plate 201, to tune a resonant frequency of the filter;

The sealing cover plate 201 is located on an upper end face, i.e., the top of the metal cavity 204, to seal the metal cavity 204.

In the present embodiment, there is an insulating fixed module 205 arranged between the lower end face of the sealing cover plate 201 and the upper end face of the dielectric resonant column 203. The insulating fixed module 205 may be in a circular column shape, or may be in any other suitable shape; and there is a hole in the middle of the insulating fixed module 205, to assemble the tuning screw 202.

The insulating fixed module 205 is located between the lower end face of the sealing cover plate 201 and the upper end face of the dielectric resonant column 203; a lower end face of the sealing cover plate 201 presses above the insulating fixed module 205 and an upper end face of the dielectric resonant column 203 supports the insulating fixed module, a pressure is formed between the sealing cover plate 201 and the dielectric resonant column 203 when the metal cavity 204 is sealed with the sealing cover plate 201, so that the dielectric resonant column 203 is fixed at the bottom of the metal cavity 204. The size of insulating fixed module 205 can ensure that the dielectric resonant column 203 is fixed at the bottom of the metal cavity 204.

In the present embodiment, the insulating fixed module 205 is fixed on the sealing cover plate 201, and is located right above the dielectric resonant column 203, thereby ensuring that it is easy for assembly and it is easy to get correct. In other embodiments of the present invention, the insulating fixed module 205 can be fixed between the sealing cover plate 201 and the dielectric resonant column 203 in any other suitable manner. For example, the insulating fixed module 205 is fixed together with the dielectric resonant column 203 in any suitable manner (for example, in a glue connection manner).

Those skilled in the art can consider that the insulating fixed module is right above the dielectric resonant column as described herein as long as the insulating fixed module is above the dielectric resonant column within an allowable offset. The key point is that the insulating fixed module can provide a pressure between the sealing cover plate and the dielectric resonant column to enable the dielectric resonant column to be fixed at the bottom of the metal cavity.

In the present embodiment, in order to achieve a filtering function of the single-ended conductive dielectric resonator, the insulating fixed module 205 is an insulator; and in order to prevent the dielectric resonator from being damaged due to a hard pressure in the assembly process, the insulating fixed module 205 is preferably an elastic insulator.

In the present embodiment, the whole process of assembling the dielectric resonator is that the lower end face of the dielectric resonant column 203 is metalized (for example, is pasted with silver); then the dielectric resonant column 203 is placed in a groove in the bottom face of the metal cavity 204; then the metal cavity 204 is fixedly sealed with the sealing cover plate 201 installed with the insulating fixed module 205; and finally, the tuning screw 202 is assembled. After the whole assembly is completed, the dielectric resonant column 203 is tightly fixed in the metal cavity 204, to form a closed resonant cavity.

After the assembly of the dielectric resonant column 203 is completed, the lower end face of the dielectric resonant column is lower than the upper surface at the bottom of the metal cavity 204. According to the electromagnetic field theory, this is more beneficial for propagation of the electric field in the medium.

The dielectric resonant column is fixed at the bottom of the metal cavity through the insulating fixed module without welding in the present embodiment, then good contact between the dielectric resonant column and the metal cavity can be ensured, and even when the metal cavity is under an external force or the metal cavity is during the process of transportation, good contact can be ensured, so that the performance and reliability of the dielectric filter are improved.

Figure 3:
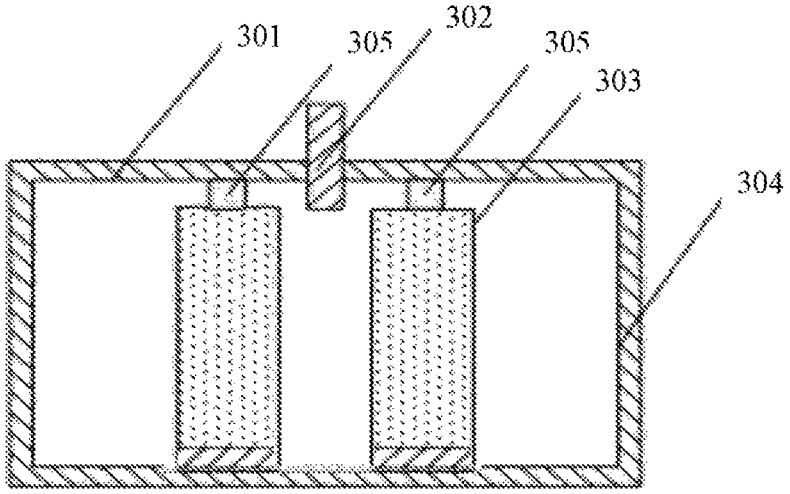
FIG. 3 is a side view of a structure of a dielectric resonator according to a second embodiment of the present invention.

With reference to FIG. 3, illustrated is a side view of a structure of a dielectric resonator according to a second embodiment of the present invention.

The dielectric resonator includes a dielectric resonant column 303, a sealing cover plate 301, a tuning screw 302, a metal cavity 304, and an insulating fixed module 305.

The dielectric resonant column 303 is located in the metal cavity 304, and the lower end face of the dielectric resonant column 303 is metalized (for example, a silver layer is plated on the lower end face of the dielectric resonant column), to ensure transmission of the electromagnetic wave between the dielectric resonant column 303 and the metal cavity 304.

The tuning screw 302 is located on the sealing cover plate 301, to tune a resonant frequency of the filter;

The sealing cover plate 301 is located on an upper end face, i.e., the top of the metal cavity 304, to seal the metal cavity 304.

Figure 4:
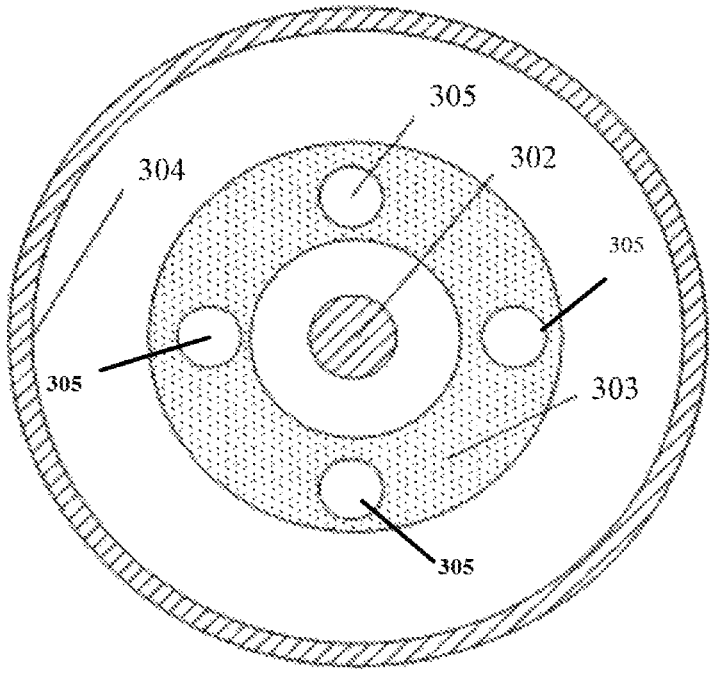
FIG. 4 is a top view of a structure of a dielectric resonator according to the second embodiment of the present invention.

In the present embodiment, there are multiple insulating fixed modules 305 arranged between the lower end face of the sealing cover plate 301 and the upper end face of the dielectric resonant column 303. Each of the insulating fixed modules 305 may be in a circular column shape, or may be in any other suitable shape; and all the insulating fixed modules 205 surround a hollow position distribution which is used to assemble the tuning screw 202. For example, as shown in FIG. 4, the dielectric resonator includes a dielectric resonant column 303, a tuning screw 302, a metal cavity 304, and an insulating fixed module 305. The dielectric resonant column 303 is located in the metal cavity 304. There are 4 insulating fixed modules 305, which are 4 insulators in a circular column shape respectively. The 4 insulators in a circular column shape surround the hollow position distribution for assembling the tuning screw 302.

The insulating fixed modules 305 are located between the lower end face of the sealing cover plate 301 and the upper end face of the dielectric resonant column 303; a lower end face of the sealing cover plate 301 presses above each of the insulating fixed modules 305 and an upper end face of the dielectric resonant column 303 supports each of the insulating fixed modules 305, a pressure is provided between the sealing cover plate 301 and the dielectric resonant column 303 when the metal cavity 304 is sealed with the sealing cover plate 301, so that the dielectric resonant column 303 is fixed at the bottom of the metal cavity 304. The insulating fixed modules 305 have a size enough to ensure that the dielectric resonant column 303 is fixed at the bottom of the metal cavity 304.

In the present embodiment, the insulating fixed module 305 are fixed on the sealing cover plate 301, and are located right above the dielectric resonant column 303, thereby ensuring that it is easy for assembly and it is easy to get correct. In other embodiments of the present invention, the insulating fixed modules 305 can be fixed between the sealing cover plate 301 and the dielectric resonant column 303 in any other suitable manner. For example, the insulating fixed modules 305 are fixed together with the dielectric resonant column 303 in any suitable manner (for example, in a glue connection manner).

In the present embodiment, in order to achieve a filtering function of the single-ended conductive dielectric resonator, the insulating fixed modules 305 are insulators; and in order to prevent the dielectric resonator from being damaged due to a hard pressure in the assembly process, the insulating fixed modules 305 are preferably elastic insulators.

In the present embodiment, the whole process of assembling the dielectric resonator is that the lower end face of the dielectric resonant column 303 is metalized (for example, is pasted with silver); then the dielectric resonant column 303 is placed in groove in the bottom face of the metal cavity 304; then the metal cavity 304 is fixedly sealed with the sealing cover plate 301 installed with the insulating fixed modules 305; and finally, the tuning screw 302 is assembled. After the whole assembly is completed, the dielectric resonant column 303 is tightly fixed in the metal cavity 304, to form a closed resonant cavity.

After the assembly of the dielectric resonant column 303 is completed, the lower end face of the dielectric resonant column is lower than the upper surface at the bottom of the metal cavity 304. According to the electromagnetic field theory, this is more beneficial for propagation of the electric field in the medium.

The dielectric resonant column is fixed at the bottom of the metal cavity through the insulating fixed module without welding in the present embodiment, then good contact between the dielectric resonant column and the metal cavity can be ensured, and even when the metal cavity is under an external force or the metal cavity is during the process of transportation, good contact can be ensured, so that the performance and reliability of the dielectric filter are improved.

The embodiments of the present invention further provide a dielectric filter, comprising one or more dielectric resonators as described in the above embodiments. In the dielectric filter, one or more dielectric resonators as described are connected together to form a multi-order dielectric filter.

The embodiments of the present invention further provide a method for assembling a dielectric resonator, comprising:

fixing a lower end face of a dielectric resonant column to a metal cavity;

installing a cover plate with an insulating fixed module on the sealed metal cavity; and assembling a tuning screw on the sealing cover plate installed on the metal cavity.

After the whole assembly is completed, the dielectric resonator is tightly fixed in the metal cavity, to form a closed resonant cavity.

A manner of fixing the lower end face of the dielectric resonant column to the metal cavity is to place and fix the dielectric resonant column in the groove in the bottom face of the metal cavity. At the same time, the present embodiment does not exclude fixing the lower end face of the dielectric resonant column in the metal cavity in other manners.

It should be noted that if the sealing cover plate is not configured with an insulating fixed module during the assembly, the above assembly method further comprises installing the insulating fixed module on the sealing cover plate.

For those skilled in the art, the method for assembling the dielectric resonator includes, but not limited to the above steps.

A person having ordinary skill in the art can understand that all or a part of steps in the above method can be implemented by programs instructing related hardware, and the programs can be stored in a computer readable storage medium, such as a read-only memory, disk or disc etc. Alternatively, all or a part of steps in the above embodiments can also be implemented by one or more integrated circuits. Accordingly, each module/unit in the above embodiments can be implemented in a form of hardware, or can also be implemented in a form of software functional module. The present document is not limited to any particular form of a combination of hardware and software.

The above embodiments are only used to illustrate the technical schemes of the present document, and are not intended to limit the present document. The present document is merely described in detail with reference to preferable embodiments. For an ordinary skilled in the art, modifications or equivalent alternatives can be made to the technical schemes of the present document without departing from the spirit and scope of the technical schemes of the present document, and all these modifications and equivalent alternatives should belong to the scope of the claims of the present document.

INDUSTRIAL APPLICABILITY

The dielectric resonant column is fixed at the bottom of the metal cavity through the insulating fixed module without welding in an embodiment of the present invention, then good contact between the dielectric resonant column and the metal cavity can be ensured, and even when the metal cavity is under an external force or the metal cavity is during the process of transportation, good contact can be ensured, so that the performance and reliability of the dielectric filter are improved.

What is claimed is:

1. A dielectric resonator comprising a dielectric resonant column, a metal cavity, a sealing cover plate and a tuning screw, wherein the dielectric resonant column is located in the metal cavity, the sealing cover plate is located on an upper end face of the metal cavity, and the tuning screw is located on the sealing cover plate, and the dielectric resonator further comprises multiple insulating fixed modules located between a lower end face of the sealing cover plate and an upper end face of the dielectric resonant column, the lower end face of the sealing cover plate presses above each of the insulating fixed modules and the upper end face of the dielectric resonant column supports each of the insulating fixed modules, a pressure is formed between the sealing cover plate and the dielectric resonant column, so that the dielectric resonant column is fixed at a bottom of the metal cavity.

2. The dielectric resonator according to claim 1, wherein, each of the multiple insulating fixed modules is an insulator.

3. The dielectric resonator according to claim 2, wherein, each of the multiple insulating fixed modules is an elastic insulator.

4. The dielectric resonator according to claim 2, wherein, the multiple insulating fixed modules are fixed on the lower end face of the sealing cover plate.

5. The dielectric resonator according to claim 3, wherein, the multiple insulating fixed modules are fixed on the lower end face of the sealing cover plate.

6. The dielectric resonator according to claim 1, wherein, the multiple insulating fixed modules are fixed on the lower end face of the sealing cover plate.

7. The dielectric resonator according to claim 1, further comprising: a silver layer plated on a lower end face of the dielectric resonant column.

8. A dielectric filter, characterized in that the dielectric filter comprises one or more connected dielectric resonators, wherein the dielectric resonator comprising a respective dielectric resonant column, a metal cavity, a sealing cover plate and a respective tuning screw, wherein the respective dielectric resonant column is located in the metal cavity, the sealing cover plate is located on an upper end face of the metal cavity, and the respective tuning screw is located on the sealing cover plate, and the one or more dielectric resonators each further comprises multiple insulating fixed modules located between the lower end face of the sealing cover plate and the upper end face of the respective dielectric resonant column, the lower end face of the sealing cover plate presses above each of the insulating fixed modules and the upper end face of the respective dielectric resonant column supports corresponding ones of the insulating fixed modules, a pressure is formed between the sealing cover plate and the respective dielectric resonant column, so that the dielectric resonant column is fixed at the bottom of the metal cavity.

9. A method for assembling a dielectric resonator, comprising:

fixing a lower end face of a dielectric resonant column to a metal cavity;

installing a sealing cover plate with multiple insulating fixed modules thereon to the metal cavity; and assembling a tuning screw on the sealing cover plate installed on the metal cavity.

10. The method according to claim 9, wherein, the step of installing a sealing cover plate with multiple insulating fixed modules on the metal cavity comprises:

fixing the multiple insulating fixed modules on a lower end face of the sealing cover plate, wherein the lower end face of the sealing cover plate presses above each of the insulating fixed modules and an upper end face of the dielectric resonant column supports each of the insulating fixed modules, a pressure is formed between the sealing cover plate and the dielectric resonant column, so that the dielectric resonant column is fixed at a bottom of the metal cavity.

11. The method according to claim 10, wherein, each of the multiple insulating fixed modules is an insulator.

12. The method according to claim 11, wherein, each of the multiple insulating fixed modules is an elastic insulator.

13. The method according to claim 9, wherein, each of the multiple insulating fixed modules is an insulator.

14. The method according to claim 13, wherein, each of the multiple insulating fixed modules is an elastic insulator.

* * * * *